US005485688A

United States Patent [19]

Gorza et al.

[11] Patent Number: 5,485,688

[45] Date of Patent: Jan. 23, 1996

[54] LEVER, PARTICULARLY FOR SKI BOOTS

[75] Inventors: Roberto Gorza, Feltre; Luca Gallina, Caerano San Marco; Pino Tessari, Riese Pio X, all of Japan

[73] Assignee: Nordica S.p.A., Trevignano, Italy

[21] Appl. No.: 158,534

[22] Filed: Nov. 29, 1993

[30] Foreign Application Priority Data

May 18, 1993 [IT] Italy ..... TV93A0054

[51] Int. Cl.[6] ..... A43B 5/04

[52] U.S. Cl. ..... 36/117; 36/50.5; 36/120; 24/715 K

[58] Field of Search ..... 36/117, 50.5, 118, 36/119, 120, 121; 24/68 SK, 71 SK, 68 F, 71 R

[56] References Cited

U.S. PATENT DOCUMENTS

| | | | |
|---|---|---|---|
| 4,150,500 | 4/1979 | Delery | 24/715 K |
| 4,669,201 | 6/1987 | Pozzobon | 36/117 |
| 4,893,419 | 1/1990 | Arieh et al. | 36/50.5 |
| 4,908,965 | 3/1990 | Iwama | 36/50.5 |
| 5,062,225 | 11/1991 | Gorza | 36/117 |
| 5,065,532 | 11/1991 | Gorza | 36/50.5 |
| 5,237,759 | 8/1993 | Chaigne | 36/117 |

FOREIGN PATENT DOCUMENTS

| | | |
|---|---|---|
| 2450575 | 10/1980 | France . |
| 2577118 | 8/1986 | France . |
| 2582486 | 12/1986 | France . |

*Primary Examiner*—Paul T. Sewell
*Assistant Examiner*—Marie Denise Patterson
*Attorney, Agent, or Firm*—Guido Modiano; Albert Josif

[57] ABSTRACT

Lever, particularly usable in ski boots of the type including a shell with which at least one quarter is associated, including a freely movable lever arm and a support which is associated with the quarter. The lever arm and the support have at least one seat for guiding at least two cables which are connected, at their ends, respectively to the quarter or to the shell and to the support. The two traction elements connect the lever arm to the support in a hinge-like manner, so as to give the lever arm the required orientation in open condition.

18 Claims, 5 Drawing Sheets

LEVER, PARTICULARLY FOR SKI BOOTS

BACKGROUND OF THE INVENTION

The present invention relates to a lever particularly usable in ski boots.

Currently, in ski boots it is known to use many types of lever for applying tension to traction elements, such as cables or bands, that allow for example to secure the flaps of a quarter or of a shell.

Conventional levers are usually constituted by a lever arm which is pivoted, at one end, at a pair of shoulders protruding from a base which is in turn rigidly coupled at the shell or at the quarter.

These conventional levers have drawbacks: since the lever arm is subject to accidental impacts during sports practice and especially during breaks, when one walks with the boot open and thus with the lever arm raised, deformations are imparted to the shoulders of the base as a consequence of these impacts; consequently the need arises to replace the entire lever-base assembly.

Furthermore, the use of a base entails additional costs due both to the component and to the production step required to couple it to the quarter or to the shell and to pivot it to the lever arm.

French patent no. 2,450,575 is known as a partial solution to these drawbacks; it discloses a lever device for locking and/or securing a ski boot, which has multiple profiles that form a rack and are orientated along the longitudinal axis. The profiles are arranged between two retention bars which have longitudinal openings at which a cable is passed; said cable can be manually made to interact at the required point of the rack.

One end of the lever arm can be arranged at a desired point formed to the rear of the quarter.

Although this solution eliminates the use of a base with its associated shoulders for the pivoting of the lever arm, drawbacks are still observed: in fact, once the skier has opened the lever arm, thus disengaging it from the quarter, said lever arm dangles to the rear of the boot and can assume random positions due to the loosening of the cable.

Thus, on one hand the lever arm interacts with the ground, for example while walking, so that the risk of impact and breakage is not fully eliminated; on the other hand its random arrangement can make the skier tend to close it in an incorrect position or can force him to otherwise restore the correct position for said lever, all this constituting an undoubtedly awkward operation, since it forces the skier to visually check an element located to the rear of the boot.

Furthermore, the cable must be arranged at the rack manually by the skier, and this is certainly not an easy operation.

SUMMARY OF THE INVENTION

The aim of the present invention is to solve the above described problems by providing a lever which has a limited number of components and always maintains, when open, a correct position for its rapid and easy closure.

Within the scope of the above aim, another object is to provide a lever which, when open, has a lever arm which neither dangles nor interacts with the ground or with the snow.

Another object is to provide a lever which, when open, allows to achieve optimum takeup for at least one traction element.

Another object is to provide a lever having a reduced size so that its protrusion with respect to the boot is limited.

A further object is to provide a lever which allows to optimally withstand any accidental impacts, in order to maintain the integrity of the structure.

Yet another object is to provide a lever which is reliable and safe in use and has low manufacturing costs.

This aim, these objects and others which will become apparent hereinafter are achieved by a lever particularly for ski boots that comprise a shell with which at least one quarter is associated, characterized in that it comprises a freely movable lever arm and a support which is associated with said at least one quarter, said lever arm and said support having at least one seat for guiding at least two traction elements which are connected, at their ends, respectively to said at least one quarter or shell and to said support, said at least two traction elements connecting said lever arm to said support in a hinge-like manner.

BRIEF DESCRIPTION OF THE DRAWINGS

Further characteristics and advantages of the present invention will become apparent from the following detailed description of a particular but not exclusive embodiment thereof, illustrated only by way of non-limitative example in the accompanying drawings, wherein.

DESCRIPTION OF THE PREFERRED EMBODIMENTS

Figure 1:
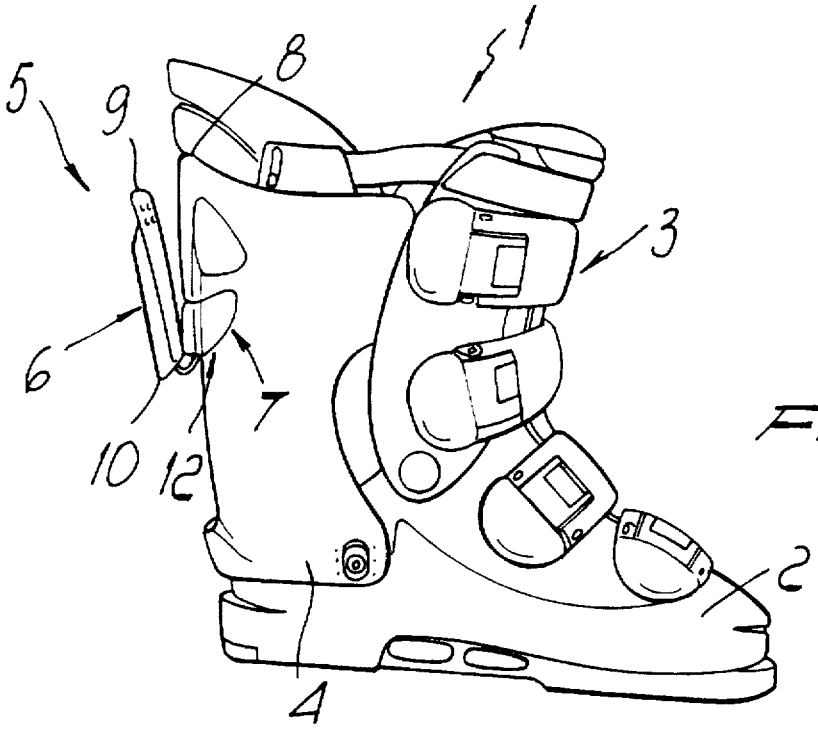
FIG. 1 is a side view of a ski boot in the condition in which the lever, according to the invention, is open.
Figure 3:
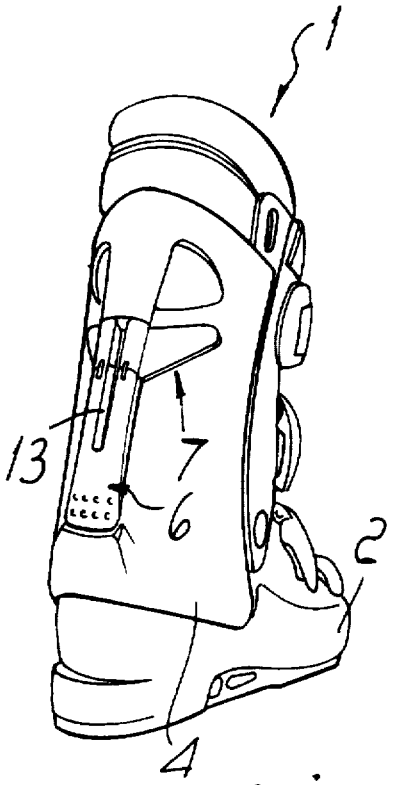
FIG. 3 is a perspective rear view of a ski boot with the lever in closed condition.
Figure 2:
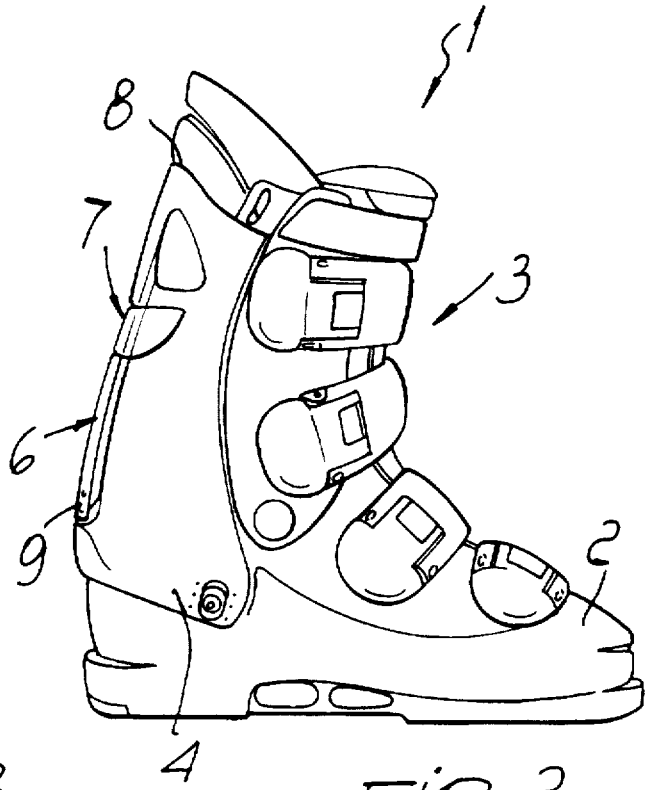
FIG. 2 is a side view of a ski boot with the lever in closed condition.
Figure 5:
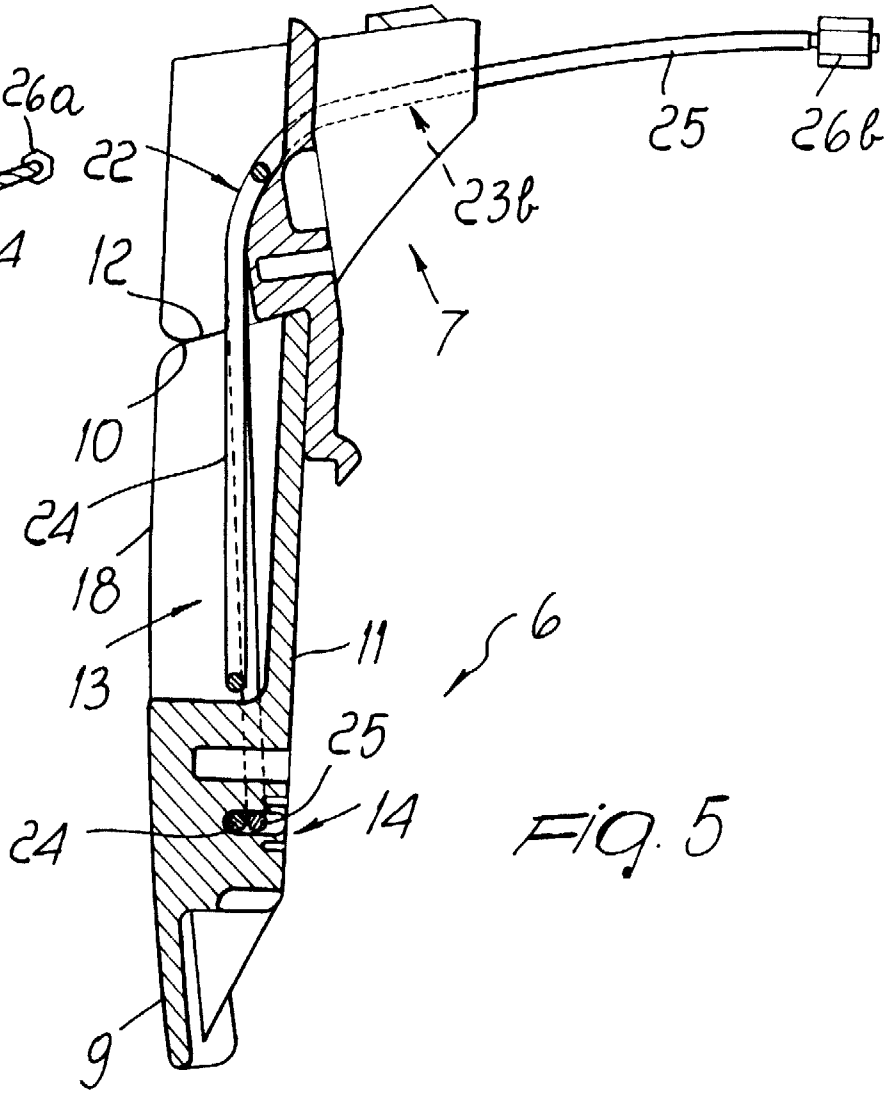
FIG. 5 is a sectional view, taken along the plane V—V of FIG. 4.
Figure 4:
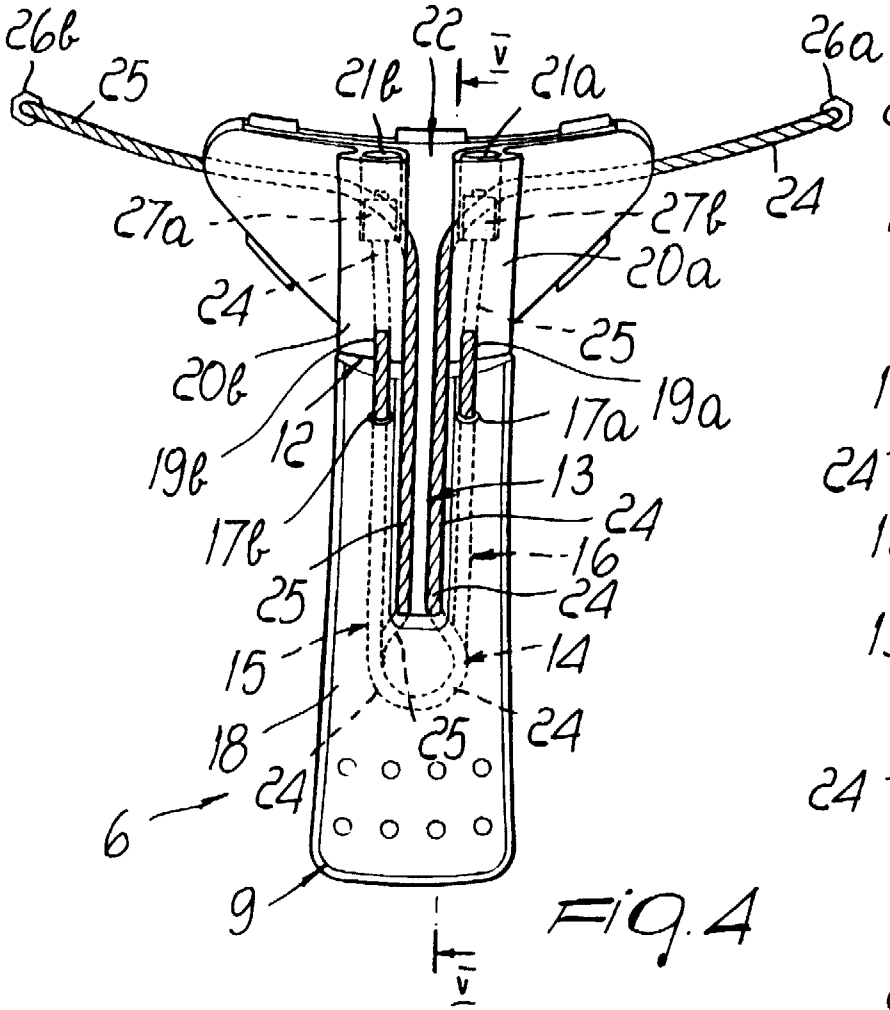
FIG. 4 is a front view of the lever in which the components of the boot have been omitted for the sake of clarity.
Figure 6:
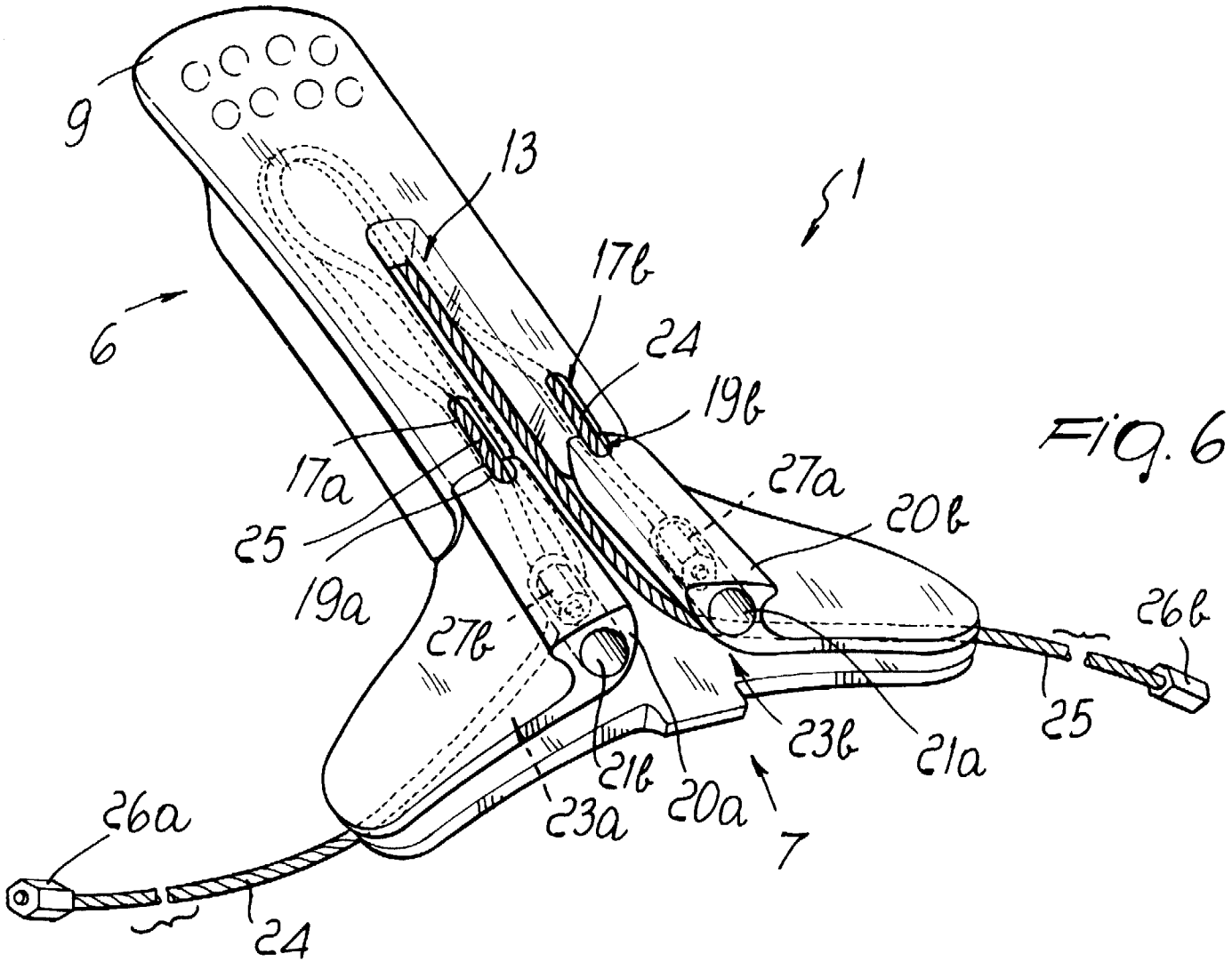
FIG. 6 is a lateral perspective view of the lever, illustrating the paths of the traction elements.

With reference to the above figures, the reference numeral 1 designates a ski boot comprising a shell 2 to which a front quarter 3 and a rear quarter 4 are articulated.

The reference numeral 5 designates the lever, which comprises a lever arm 6 constituted by a body which is freely movable and distinct with respect to a support 7 which is associated, in a rearward position, with the rear quarter 4, in a region adjacent to the upper perimetric edge thereof.

The lever arm 6 is constituted by a body which has a first freely movable end 9 that can be gripped by the user and a second end 10 which is rounded or shaped like an inclined plane which delimits an obtuse angle together with the base 11 if one assigns a positive value to counterclockwise rotation.

Said second end 10 can be arranged adjacent to a complementarily shaped third end 12 of the support 7.

A first seat 13 is formed axially with respect to the lever arm 6 starting from the second end 10 and is connected, proximate to the first end 9, to a second annular seat 14 which acts as a guide and is in turn connected to a third seat 15 and to a fourth seat 16 that are formed laterally with respect to the first seat 13, within the body of the lever arm 6.

Said third and fourth seats are connected, through a pair of first openings or slots 17*a* and 17*b*, to the upper surface 18 of the lever arm 6 which is opposite to the base 11.

A pair of second openings or slots 19*a* and 19*b* is formed at said first openings or slots, along the same axis and at the third end 12 of the support 7; said second openings or slots affect a pair of longitudinal protrusions 20*a* and 20*b* that protrude at the upper part of the support 7 on the side opposite to the surface interacting with the rear quarter.

The pair of second openings or slots 19*a* and 19*b* is thus connected to a pair of fifth seats 21*a* and 21*b* formed axially to said pair of longitudinal protrusions 20*a* and 20*b*.

A sixth seat 22 is formed between said longitudinal protrusions and has the same axis as the first seat 13 formed on the lever arm 6; said sixth seat 22 is connected to the inside of the quarter 4 by means of a pair of adapted guides 23*a* and 23*b* formed below said pair of longitudinal protrusions 20*a* and 20*b* and generally below said support 7.

The lever also comprises a first traction element 24 and a second traction element 25, which are preferably constituted by a first cable and a second cable which have a fourth end 26*a* and 26*b* connected to the front quarter 3 or to the shell 2.

Starting from said fourth end, the first and second traction elements affect the pair of guides 23*a* and 23*b*, then arrange themselves at the sixth seat 22 formed on the support 7 and subsequently at the first seat 13 formed on the lever arm 6.

At this point the first and second traction elements are guided at the second annular seat 14 and then passed respectively at the third seat 15 and at the fourth seat 16 which are formed on the body of the lever arm 6.

The first and second cables then exit, through the pair of first openings or slots 17*a* and 17*b*, outside the lever arm 6 and the support 7 and then re-enter, through the pair of second openings or slots 19*a* and 19*b*, the pair of fifth seats 21*a* and 21*b* formed on the pair of longitudinal protrusions 20*a* and 20*b* that protrude from the support 7.

The fifth ends 27*a* and 27*b* of the first traction element 24 and of the second traction element 25 respectively are associated at the protrusions 20*a*, 20*b*.

The passage of said traction elements between the pair of first and second openings or slots formed on the lever arm and on the support allows the hinge-like connection between said lever arm and said support.

In fact, as shown in FIG. 1, when the lever arm 6 is open, the portions of the first and second traction elements that extend from the fifth ends 27*a*, 27*b* to the second annular seat 14 maintain the connection between the lever arm and the support, acting as a hinge element, whereas the parts of the first and second traction elements that affect the first seat 13 and the sixth seat 22 allow to release the amount of cable that allows to open the quarters.

It has thus been observed that the invention has achieved the intended aim and objects, a lever having been obtained which on one hand eliminates a component constituted by the base usually associated with the quarter and on the other hand allows to precisely orientate and control the positioning of the lever arm by means of the cables in open condition.

The lever arm thus always arranges itself in a position which is approximately parallel to the surface of the rear quarter, allowing the skier to close the lever without having to check the positioning of said lever arm.

The arrangement of the lever arm and of the support furthermore allows to takeup and thus release a significant amount of cable while allowing to contain the protrusion of the lever, which can be accommodated within an adapted seat formed at the rear quarter; in fact, connection of the lever arm by means of the cables allows said arm to fully overturn through 180° and to exit from the seat of the quarter.

Finally, the coupling between the lever arm 6 and the support 7 by means of the first and second traction elements gives the lever high impact-resisting elasticity, protecting it from possible breakage.

The lever according to the invention is naturally susceptible to numerous modifications and variations, all of which are within the scope of the same inventive concept.

Figure 8:
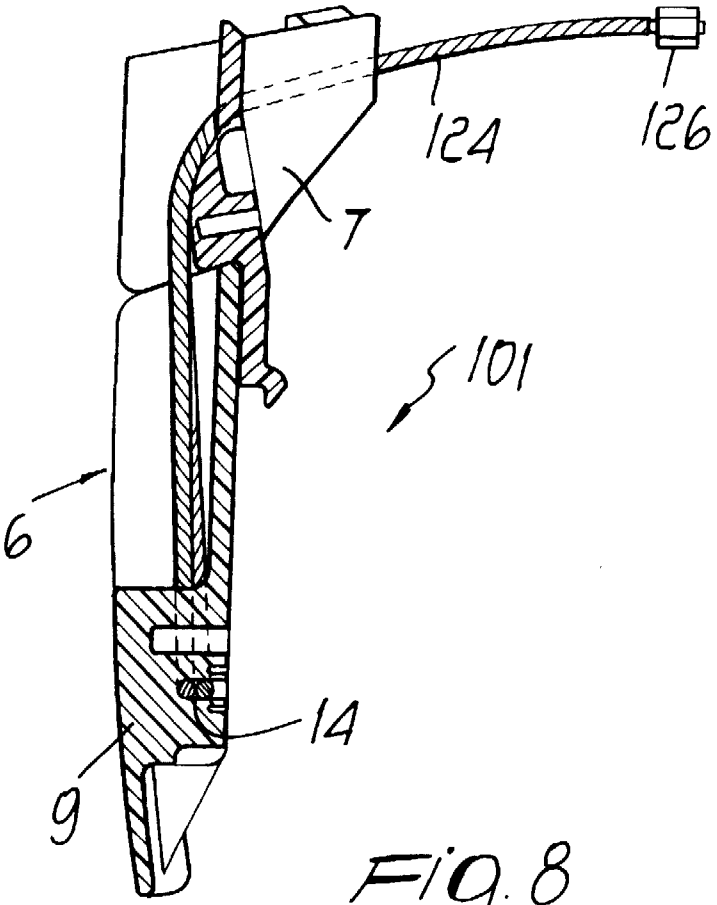
FIG. 8 is a sectional side view of the lever of FIG. 7, according to the plane VIII—VIII.
Figure 7:
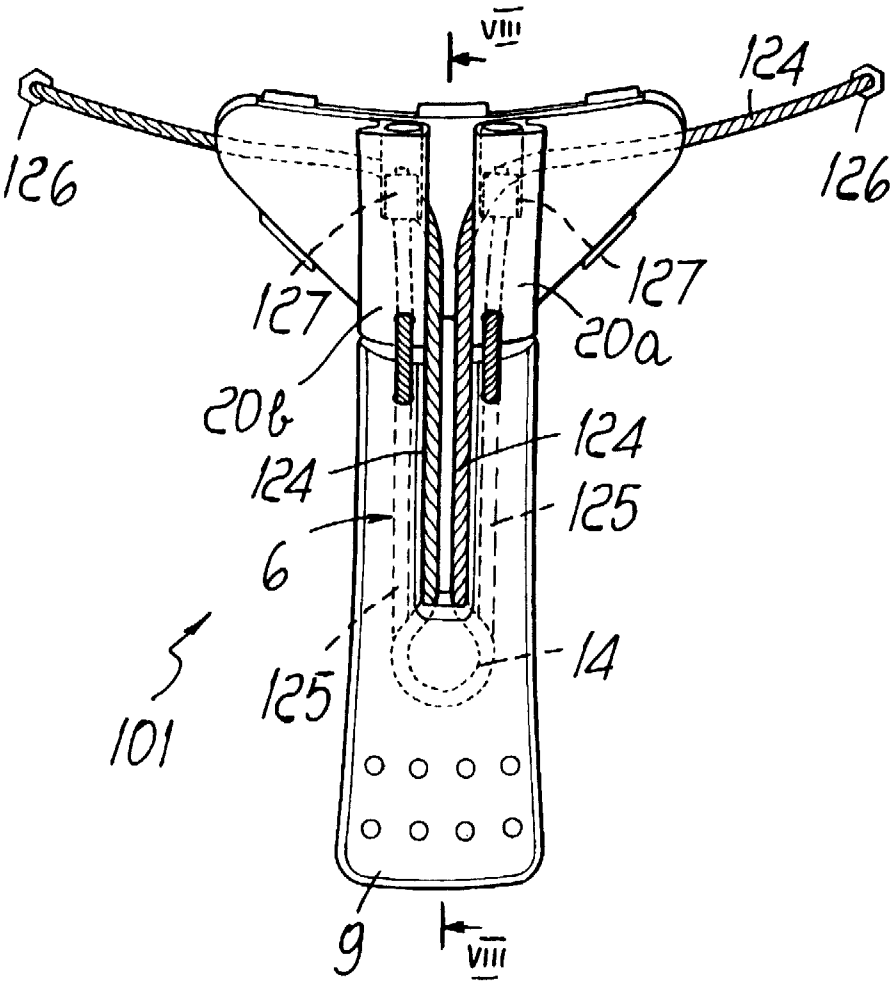
FIG. 7 is a front view of the lever according to a second aspect of the invention.
Figure 9:
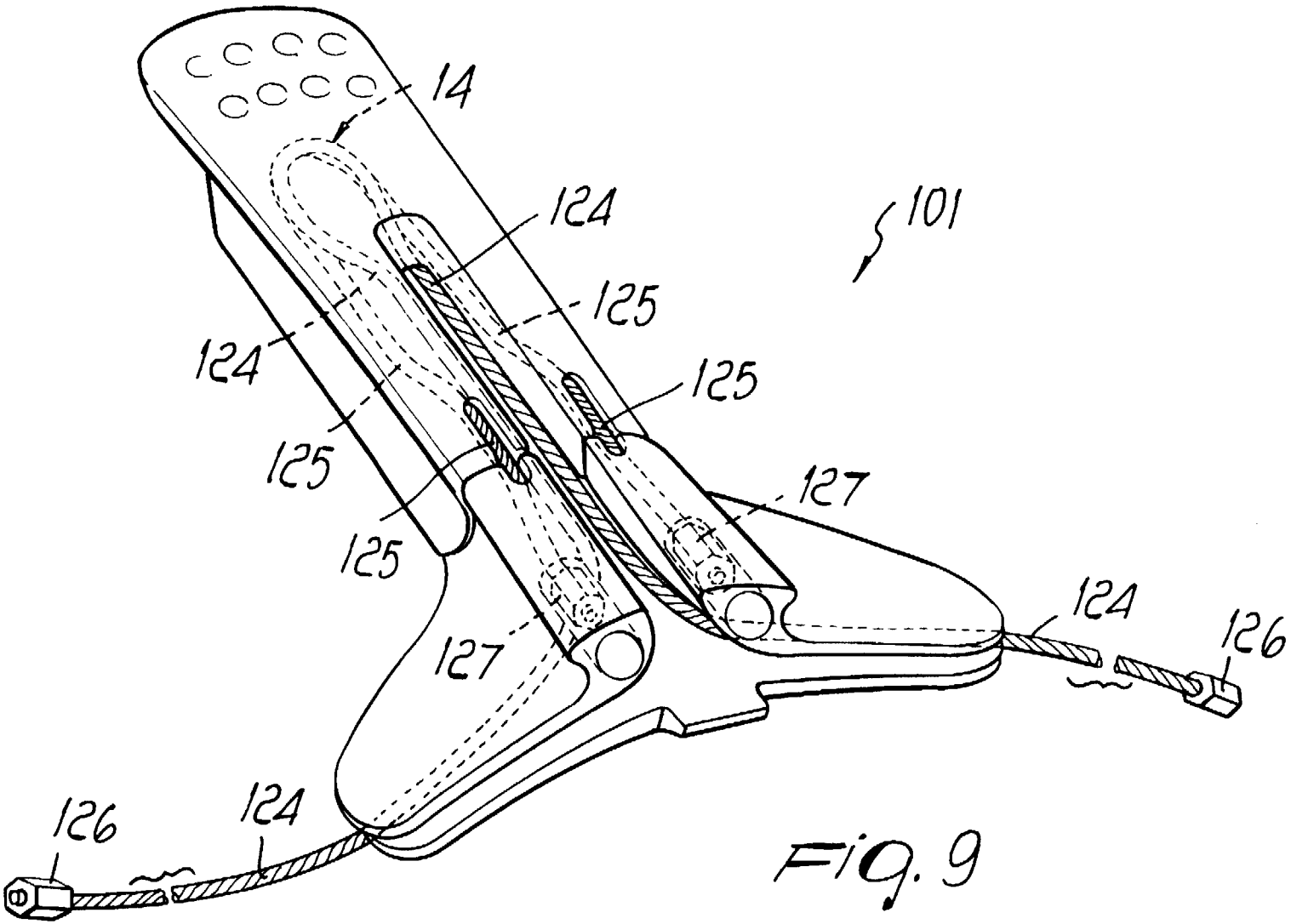
FIG. 9 is a side perspective view of the lever of FIGS. 7 and 8.

FIGS. 7–9 show a lever 101 according to a second aspect of the invention and wherein like reference numerals denote similar features to those of FIGS. 1–6.

According to this embodiment, a first traction element, constituted by a cable 124, has ends 126 connected to the quarter of the boot or to the shell, while a second traction element, constituted by a cable 125 has end 127 associated with the protrusions 20*a* and 20*b* of the support 7.

In this manner, the first cable 124 is operated through the lever 101 for closing and opening the boot while the second cable 125 connects the movable end 9 of the lever to the support 7. An advantage of this arrangement is that the lever can be closed more easily because the second cable 125 is not tensioned. Another advantage is that the first cable 124 is always centered with respect to the lever by being able to slide in the guide seat 14.

The dimensions and the materials that constitute the individual components of the lever may be the most pertinent according to the specific requirements.

We claim:

1. In combination, a lever (5) and a ski boot (1), said ski boot (1, 2, 3) comprising a shell (2), at least one quarter (3) connected to said shell (2), and an upper perimetric edge (8) defined by said quarter (3), said lever (5) comprising;

a support (7) connected to said quarter (3) at a portion thereof adjacent to said upper perimetric edge (8);

at least two traction elements (24,25) each having one end connected to said ski boot (2, 3) and another end (27*a*, 27*b*) connected to said support (7);

a lever arm (6) having a base (11), and an upper surface (18) located opposite said base (11), said lever arm (6) being connected to said at least two traction elements (24, 25);

a first end (9) defined by said lever arm (6), said first end (9) being movable with respect to said support (7);

a second end (10) defined by said lever arm (6) opposite said first end thereof;

a third end (12) defined by said support (7) and shaped complementarily with respect to said second end (10), said second end (10) being arranged adjacent to said third end (12);

a first seat (13), a second seat (14), a third seat (15) and a fourth seat (16) defined in said lever arm (6) for accommodating said at least two traction elements (24,25), said first seat (13) formed axially with respect to said lever arm (6) and extending thereon from said second end (10), said second seat consisting of an annular seat (14) defined on said lever arm (6) for guiding said traction elements (24, 5) and connected to said first seat (13) at a location proximate to said first end (9), said third seat (15) and said fourth seat (16) being formed laterally with respect to said first seat (13) within said lever arm (6) and connected to said second seat (14);

a pair of first openings (17*a*, 17*b*) connecting said third seat (15) and said fourth seat (16) to said upper surface (18) of said lever arm (6);

a pair of longitudinal protrusions (20*a*, 20*b*) protruding above said support (7) on said upper surface (18) of said lever arm (6), and;

a pair of second openings (19*a*, 19*b*) formed in said pair of longitudinal protrusions (20*a*, 20*b*) coaxially with respect to said first openings (17*a*, 17*b*).

2. Combination according to claim 1, wherein said pair of second openings (19*a*, 19*b*) is connected to a pair of fifth seats (21*a*, 21*b*), said fifth seats (21*a*, 21*b*) being formed axially with respect to said pair of longitudinal protrusions (20*a*, 20*b*).

3. Combination according to claim 2, further comprising a sixth seat (22) formed coaxially with respect to said first seat (13) between said pair of protrusions (20*a*, 20*b*), said traction elements (24,25) extending along said sixth seat (22) and through a pair of guides (23*a*, 23*b*) formed below said pair of longitudinal protrusions (20*a*, 20*b*) for connection to said ski boot (1).

4. Combination according to claim 3, wherein said traction elements (24, 25) comprise a first traction element (24) and a second traction element (25), said first traction element (24) and said second traction element (25) being constituted by a first and second cables (24, 25), said first and second cables each having an end (26*a*, 26*b*) connected to said ski boot (1).

5. Combination according to claim 4, wherein said traction elements (24, 25) extend from said end (16*a*, 26*b*) connected to said ski boot to said pair of guides (23*a*, 23*b*), from said pair of guides (23*a*, 23*b*) to said sixth seat (22), and from said sixth seat (22) formed on said support to said first seat (13) formed on said lever arm (6).

6. Combination according to claim 5, wherein said traction elements (24, 25) extend from said first seat (13) to said second seat (14), from said second seat (14) to said third seat (15) and to said fourth seat (16) formed on said lever arm (6), said traction elements (24, 25) exiting said lever arm through said pair of first openings (17*a*, 17*b*) and then entering said pair of fifth seats (21*a*, 21*b*), formed in said longitudinal protrusions (20*a*, 20*b*) of said support (7), through said pair of second openings (19*a*, 19*b*).

7. Combination according to claim 6, wherein each said other end (27*a*, 27*b*) of said traction elements (24,25 ) is connected to said support (7) within said pair of fifth seats (21*a*, 21*b*).

8. Combination according to claim 7, wherein passage of said first and second traction elements (24, 25) between said pair of first openings (17*a*, 17*b*) formed on said lever arm (6) and said pair of second openings (19*a*, 19*b*) formed in said pair of longitudinal protrusions (20*a*, 20*b*) formed on said support (7) provides hinge-like connection between said lever arm (6) and said support (7).

9. In a ski boot (1, 2, 3), a lever (5) comprising;

support means (7) connected to said ski boot (1, 2, 3) and defining at least two seats (21*a*, 21*b*);

a lever arm (6) located proximate to said support means (7);

guide means (14) connected to said lever arm (6), and;

at least two traction elements (24, 25, 124, 125) each having at least one end (26*a*, 26*b*, 126) and at least another end (27*a*, 27*b*, 127), said at least one end (26*a*, 26*b*, 126) of at least one of said traction elements (24, 25, 124) being connected to said ski boot (1, 2, 3), said at least another end (17*a*, 27*b*, 127) of at least one of said traction elements (24, 25, 125) being connected to said support means (7) for connecting said lever arm (6) to said support means (7);

wherein at least one of said traction elements (24, 25, 124) extends in a first plane from said ski boot (1, 2, 3), through said seats (21*a*, 21*b*) formed in said support means (7), to said guide means (14), and;

wherein said at least one of said traction elements (24, 25, 125) extends in a second plane between said guide means (14) and said support means (7).

10. In a ski boot (1, 2, 3), a lever (5) comprising;

support means (7) connected to said ski boot (1, 2, 3) and defining at least two seats (21*a*, 21*b*);

a lever arm (6) located proximate to said support means (7);

guide means (14) connected to said lever arm (6), and;

at least two traction elements (24, 25, 124, 125) each having at least one end (26*a*, 26*b*, 126) and at least another end (27*a*, 27*b*, 127), said at least one end (26*a*, 26*b*, 126) of at least one of said traction elements (24, 25, 124) being connected to said ski boot (1, 2, 3), said at least another end (17*a*, 27*b*, 127) of at least one of said traction elements (24, 25, 125) being connected to said support means (7) for connecting said lever arm (6) to said support means (7), at least one of said traction elements (24, 25, 124) extending in a first plane from said ski boot (1, 2, 3), through said seats (21*a*, 21*b*) formed in said support means (7), to said guide means (14), and at least one of said traction elements (24, 25, 125) extending in a second plane between said guide means (14) and said support means (7), wherein said second plane is defined by said at least one of said traction elements (24, 25, 125) extending between said guide means (14) and said support means (7), and wherein said first plane is defined by said at least one of said traction elements (24, 124, 125) extending between said support means (7) and said guide means (14), said second plane being spaced further from said ski boot than said first plane.

11. A combination according to claim 10, wherein said ski boot (1, 2, 3) comprises a quarter (3) having an upper perimetric edge (8), said support means (7) comprising a support (7) connected to said quarter (3) at a portion thereof adjacent to said upper perimetric edge (8), said lever arm (6) having a base (11) and an upper surface (18), said base (11) being located opposite said upper surface (12), said lever arm (6) and said support (7) being both connected to at least one of said at least two traction elements (24, 25, 125) for connecting said lever arm (6) to said support (7) in a hinge-like manner;

wherein said first plane and said second plane defined by said traction elements (24, 25, 124, 125) are located between said base (11) and said upper surface (12).

12. A combination according to claim 11, wherein said lever arm further comprises a first seat (13), a second seat (14), a third seat (15) and a fourth seat (16) for accommodating said at least two traction elements (24,25, 124, 125), said first seat (13) being formed axially with respect to said lever arm (6), said second seat (14) constituting said guide means (14) and defining on said lever am (6), an annular guide (14) for said traction elements (24, 25), said second seat (14) being connected to said first seat (13), said third seat (15) and said fourth seat (16) being formed laterally with respect to said first seat (13) within said lever arm (6) and connected to said second seat (14).

13. Combination according to claim 12, further comprising;

a pair of first openings (17*a*, 17*b*) connecting said third seat (15) and said fourth seat (16) to said upper surface (18) of said lever arm (6);

a pair of longitudinal protrusions (20*a*, 20*b*) protruding above said support (7) on said upper surface (18) of said lever arm (6), and;

a pair of second openings (19*a*, 19*b*) formed in said pair of longitudinal protrusions (20*a*, 20*b*) coaxially with respect to said first openings (17*a*, 17*b*).

14. In a ski boot (1, 2, 3), a lever (5) comprising;

support means (7) connected to said ski boot (1, 2, 3) and defining at least two seats (21*a*, 21*b*);

a lever arm (6) located adjacent to said support means (7);

guide means (14) connected to said lever arm (6), and;

at least two traction elements (24, 25, 124, 125) each having at least one end (26*a*, 26*b*, 126) and at least another end (27*a*, 27*b*, 127), said at least one end (26*a*, 26*b*, 126) of at least one of said traction elements (24, 25, 124) being connected to said ski boot (1, 2, 3), said at least another end (17*a*, 27*b*, 127) of at least one of said traction elements (24, 25, 125) being connected to said support means (7) for connecting said lever arm (6) to said support means (7);

wherein at least one of said traction elements (24, 25, 124) extends from said ski boot (1, 2, 3), and defines a first plane extending from said seats (21*a*, 21*b*) formed in said support means (7), to said guide means (14), and;

wherein said at least one of said traction elements (24, 25, 125) defines a second plane extending between said guide means (14) and said support means (7), said second plane being spaced further from said ski boot than said first plane.

15. A combination according to claim 14, wherein said at least two traction elements (124, 125) each have two ends (126, 127), said two ends (126) of one of said traction elements (124) being connected to said ski boot (1, 2, 3), said two ends (127) of another one of said traction elements (125) being connected to said support means (7);

wherein one of said traction elements (124) extends from said ski boot (1, 2, 3), and further extends in a first plane between said seats (21*a*, 21*b*) formed in said support means (7) and said guide means (14), and;

wherein said other one of said traction elements (125) extends in a second plane between said support means (7) and said guide means (14) for hinge-like interconnection of said lever arm (6) to said support means (7).

16. A combination according to claim 14, wherein said at least two traction elements (24, 25) each have at least one end (26*a*, 26*b*) and at least another end (27*a*, 27*b*), said one end (26*a*, 26*b*) of each of said traction elements (24, 25) being connected to said ski boot (1, 2, 3), said other end (27*a*, 27*b*) of each of said traction elements (24, 25) connected to said support means (7), for hinge-like interconnection of said lever arm (6) to said support means (7);

wherein said traction elements (24, 25) extend from said ski boot (1, 2, 3) to said support means (7) and thereafter extend in a first plans from said support means (7) to said guide means (14), and;

wherein said traction elements (24, 25) extend in a second plane from said guide means (14) to said support means (7).

17. A combination according to claim 14, wherein said ski boot (1, 2, 3) comprises a quarter (3) having an upper perimetric edge (8), said support means (7) comprising a support (7) connected to said quarter (3) at a portion thereof adjacent to said upper perimetric edge (8), said lever arm (6) having a base (11) and an upper surface (18), said base (11) being located opposite said upper surface (12), said lever arm (6) and said support (7) being both connected to at least one of said at least two traction elements (24, 25, 125) for connecting said lever arm (6) to said support (7) in a hinge-like manner;

wherein said first plane and said second plane defined by said traction elements (24, 25, 124, 125) are located between said base (11) and said upper surface (12).

18. A combination according to claim 17, wherein said lever arm further comprises a first seat (13), a second seat (14), a third seat (15) and a fourth seat (16) for accommodating said at least two traction elements (24,25, 124, 225), said first seat (13) being formed axially with respect to said lever arm (6), said second seat (14) constituting said guide means (14) and defining on said lever arm (6), an annular guide (14) for said traction elements (24, 25), said second seat (14) being connected to said first seat (13), said third seat (15) and said fourth seat (16) being formed laterally with respect to said first seat (13) within said lever arm (6) and connected to said second seat (14).

* * * * *

UNITED STATES PATENT AND TRADEMARK OFFICE

CERTIFICATE OF CORRECTION

PATENT NO. : 5,485,688

DATED : January 23, 1996

INVENTOR(S) : Roberto GORZA, Luca GALLINA, Pino TESSARI

It is certified that error appears in the above-indentified patent and that said Letters Patent is hereby corrected as shown below:

On the title page, item [75], change "all of Japan" to --all of Italy--.

Signed and Sealed this

Twenty-third Day of April, 1996

*Attest:*

Bruce Lehman

BRUCE LEHMAN

*Attesting Officer*

*Commissioner of Patents and Trademarks*